United States Patent [19]

Defibaugh et al.

[11] 4,242,535

[45] Dec. 30, 1980

[54] CONNECTION OF WIRES TO COMPONENTS HAVING TWO PRONGS

[75] Inventors: George R. Defibaugh, Camp Hill; Suel G. Shannon, Harrisburg; Robert C. Swengel, Jr., York, all of Pa.

[73] Assignee: AMP Incorporated, Harrisburg, Pa.

[21] Appl. No.: 79,649

[22] Filed: Sep. 27, 1979

[51] Int. Cl.[3] ..... H01R 4/18

[52] U.S. Cl. ..... 174/88 R; 113/119; 206/330; 339/276 SF

[58] Field of Search ..... 339/276 SF, 276 T; 206/330; 113/119; 29/854, 862, 871, 884; 174/88 R

[56] References Cited

U.S. PATENT DOCUMENTS

| | | | |
|---|---|---|---|
| 2,871,551 | 2/1959 | Harris | 113/119 X |
| 3,075,167 | 1/1963 | Kinkaid . | |
| 3,516,157 | 6/1970 | Brown . | |
| 3,625,350 | 12/1971 | Ray | 339/276 SF X |
| 3,746,777 | 7/1973 | Peek . | |
| 3,918,789 | 11/1975 | Davis | 339/276 T |
| 3,922,480 | 11/1975 | Woofter . | |
| 3,937,403 | 2/1976 | Lawson | 339/276 T |
| 3,991,452 | 11/1976 | Zahn et al. . | |

*Primary Examiner*—Roy N. Envall, Jr.
*Attorney, Agent, or Firm*—Frederick W. Raring

[57] ABSTRACT

A continuous strip of stamped and formed connecting devices comprises a carrier strip having a plurality of sets of splicing devices extending from one of its side edges. Each set comprises first and second splicing devices which are symmetrical with respect to an axis that extends medially between their adjacent sides. Each splicing device has a wire crimp portion which is adjacent to the carrier strip, a connecting transition portion, and a prong crimp portion which is spaced from the carrier strip. The transition portions of each set extend convergently towards the axis of symmetry so that the prong crimp portions are closely spaced. The strip is used to connect first and second wires to first and second prongs extending from a component. Improved manufacturing techniques involving use of this strip for connecting the wires to the prongs are also disclosed.

10 Claims, 12 Drawing Figures

CONNECTION OF WIRES TO COMPONENTS HAVING TWO PRONGS

FIELD OF THE INVENTION

This invention relates to terminal strip of a specialized nature for connecting wires to prongs which extend from an electrical component and to manufacturing methods for connecting wires to components.

BACKGROUND OF THE INVENTION

It is common practice to produce a variety of electrical components, such as heat or pressure sensors, indicator lights, switches, relays, and so on, with two relatively closely spaced prongs extending from the component. The manufacturer using the component connects wires of required lengths to the prongs prior to installing the component in the equipment being produced and then connects the free ends of the wires into the circuitry of the equipment. The manufacturing operations required to connect the wires to the component prongs are quite often reltively slow, expensive and unsatisfactory, for the reason that it is customary to handle each component individually and connect the wires to the component prongs by soldering, or by crimping operations which require manual handling.

The present invention is directed to the achievement of improved manufacturing methods in which a high degree of automation is achieved in connecting wires to component prongs. The invention is further directed to the achievement of a strip of splicing devices which can be used in automated manufacturing operations in which wires are connected to component prongs.

The practice of the invention requires the use of a continuous strip of specialized stamped and formed connecting means. The strip comprises a carrier strip having a plurality of sets of splicing devices extending from one of its side edges. Each set of splicing devices comprises first and second splicing devices which are similar to each other and which are symmetrical with respect to an axis of symmetry that extends medially between the first and second splicing devices. Each splicing device has a U-shaped wire crimp portion which is adjacent to the carrier strip, an intermediate connecting transition portion which extends from the wire crimp portion away from the carrier strip, and a prong crimp portion which is spaced from the carrier strip and is on the end of the transition portion. The prong crimp portions have a generally J-shaped cross section and are oriented as mirror images of each other with the low sidewalls of the J-shaped cross section being adjacent to the axis of symmetry. The transition portions of the first and second splicing devices extend obliquely and convergently from the wire crimp portions towards the axis of symmetry so that the prong crimp portions are spaced apart by a lesser distance than are the wire crimp portions.

In use, the strip is first fed to a first crimping press in which the prongs of the components are connected to the prong crimp portions by crimping the prong crimp portions of each set onto the prongs of a component. This manufacturing operation produces a continuous composite strip consisting of the connecting means strip with the components carrier thereon. This composite strip can be trans-shipped if required on a reel to a second apparatus in which the wire crimp portions of each set are crimped onto wires and separated from the carrier strip to produce the terminated component having wires extending therefrom.

DESCRIPTION OF THE DRAWINGS

FIG. 3 is a view similar to FIG. 2 but showing components connected to, and carried by, the strip by means of crimped connections.

PRACTICE OF THE INVENTION

Figure 1:
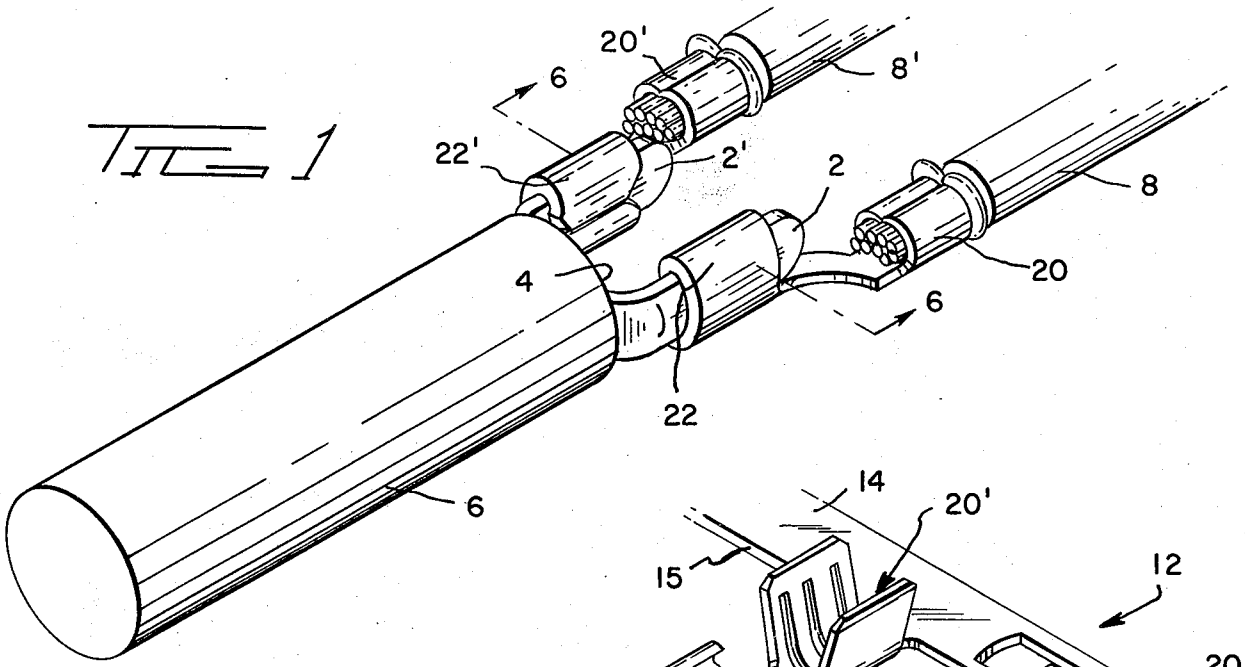
FIG. 1 is a perspective view of an electrical component having wires connected to its terminal prongs in accordance with the invention.
Figure 2:
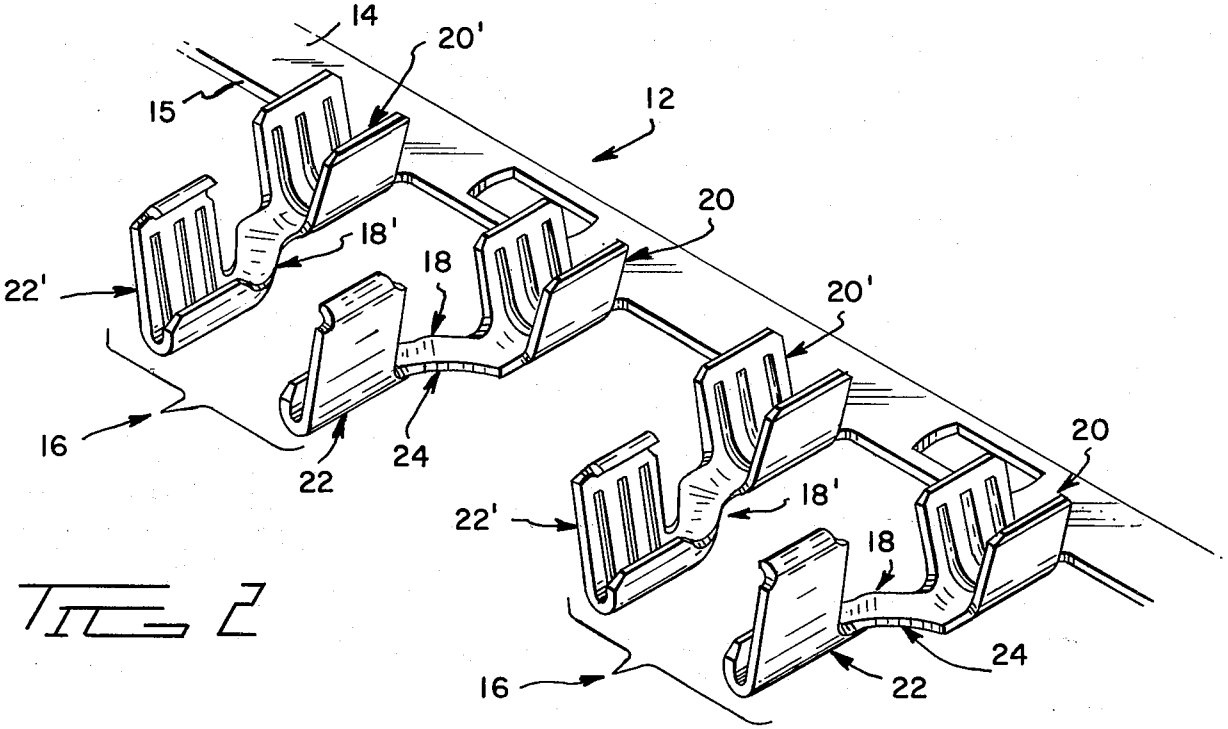
FIG. 2 is a perspective view of a connecting means strip used in the practice of the invention.
Figure 9:
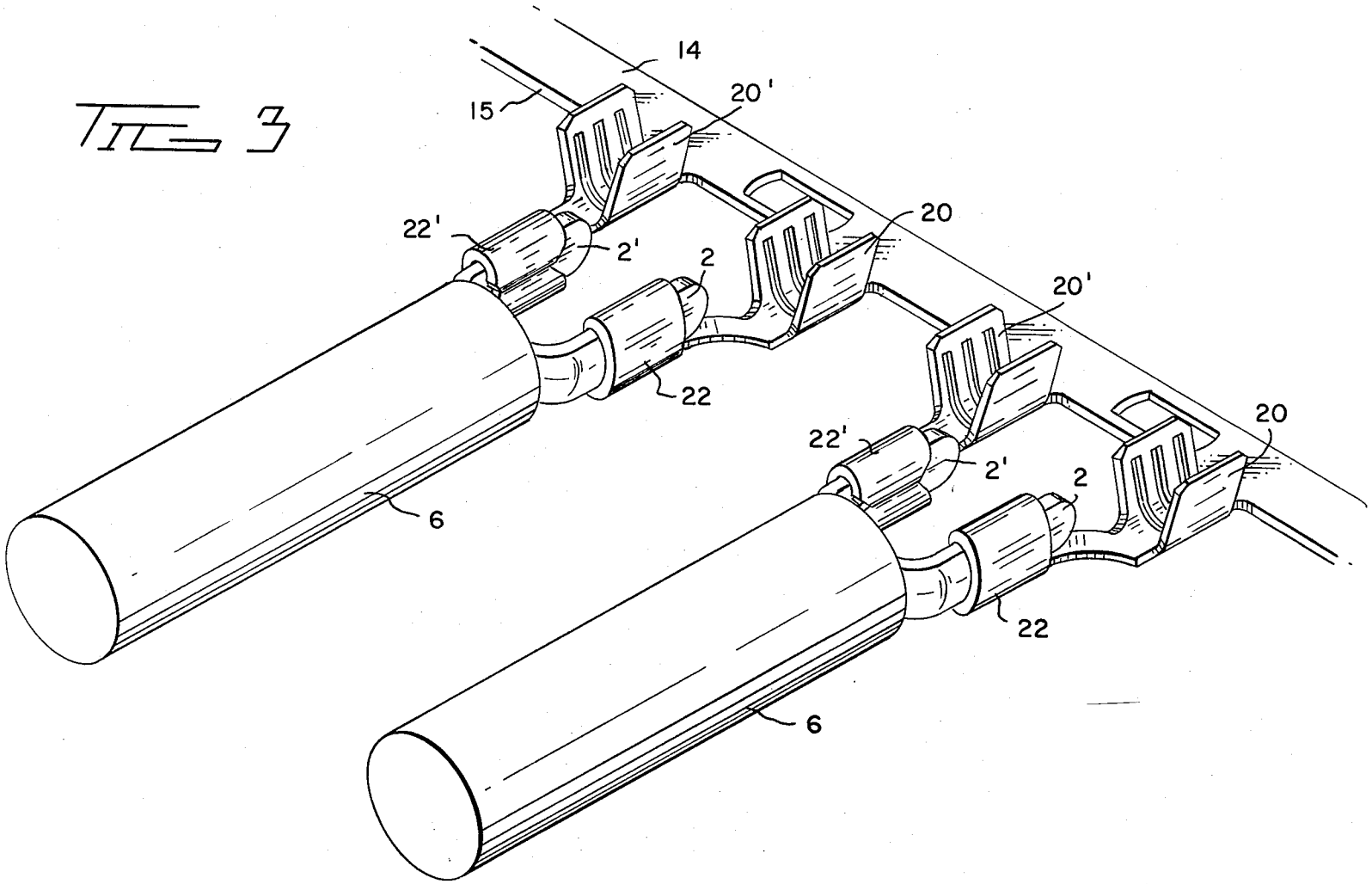
FIG. 9 is a view taken along the lines 9—9 of FIG. 8.

The invention is directed to the achievement of a strip of connecting means, and to manufacturing methods for connecting first and second wires 8, 8' (FIG. 1) to first and second prongs 2, 2' which extend from one end 4 of a cylindrical electrical component 6. The component itself may be in the form of sensor, switch, an indicator light, or a variety of other electrical devices and its shape may differ from the shape shown in FIG. 1. Commonly, however, such components will have relatively closely spaced prongs as shown at 2, 2' extending therefrom.

In accordance with the invention, a continuous strip 12 of stamped and formed connecting means is provided which comprises a continuous carrier strip 14, from one side edge 15 of which there extends a plurality of sets 16 of splicing devices. Each set comprises first and second splicing devices 18, 18' which are similar to each other in that they are mirror images of each other with respect to an axis of symmetry 50 which extends normally of the carrier strip 14 and medially between the first and second splicing devices 18, 18'. Accordingly, only the first splicing device 18 is described in detail below.

Splicing device 18 comprises a wire crimp portion 20, a prong crimp portion 22, and an intermediate transistion portion 24. The wire crimp portion 20 is generally U-shaped and comprises a web 26 and sidewalls 28, the web being connected to the carrier strip at one of its ends by a short connecting neck section 30.

The prong crimp portion 22 is generally J-shaped comprising a relatively narrow web 32, a low sidewall 34, and a relatively high sidewall 36 which is laterally formed at its upper free end towards the low sidewall, as shown at 38. The internal surface of the web is intended, as shown at 40, to form a flat external surface 42. The provision of this flat surface stabilizes the prong crimp portion on the anvil at the time it is crimped, as will be explained below. Both the prong crimp portions and the wire crimp portion may be provided with indentations, as shown at 39, which form corrugations and improved retention when these portions are crimped onto prongs and wires.

The previously identified axis of symmetry 50 extends medially between the first and second splicing devices 18, 18' and the prong crimp portions are oriented in a mirror image relationship with their short or low sidewalls 34, 34' proximate to the axis 50.

Figure 7:
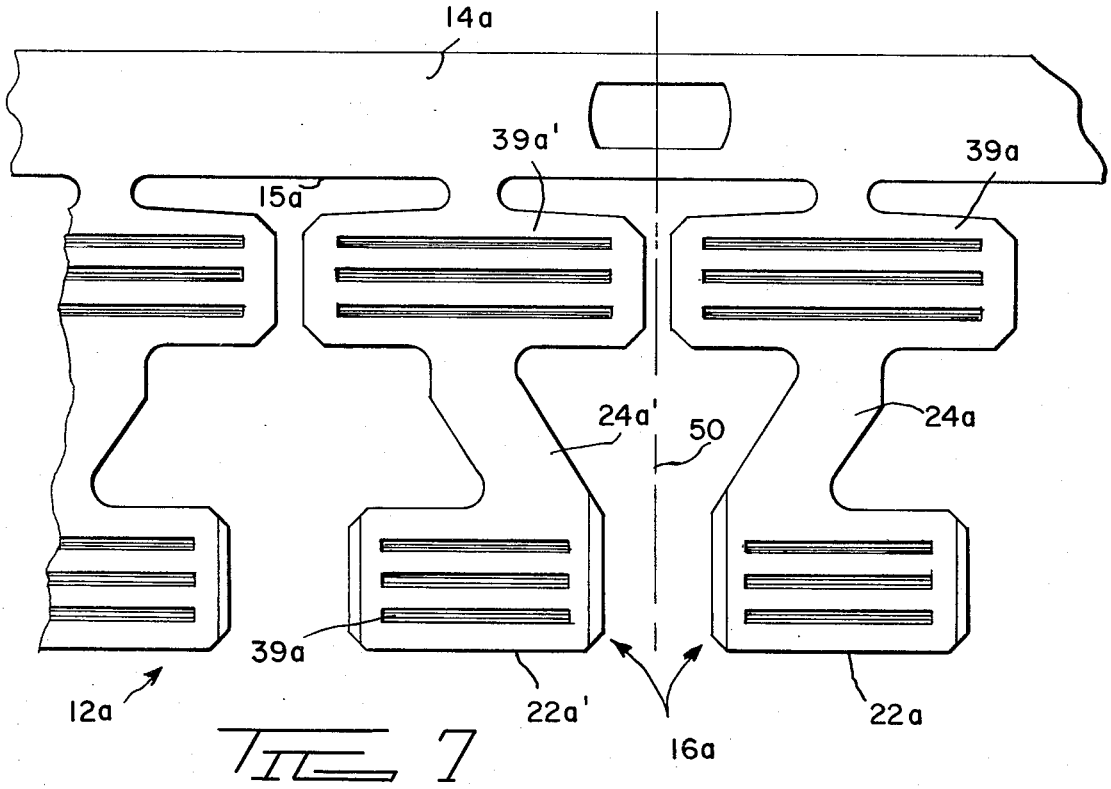
FIG. 7 is a plan view of a portion of the blanked strip from which the strip of FIG. 2 is produced and formed.
Figure 8:
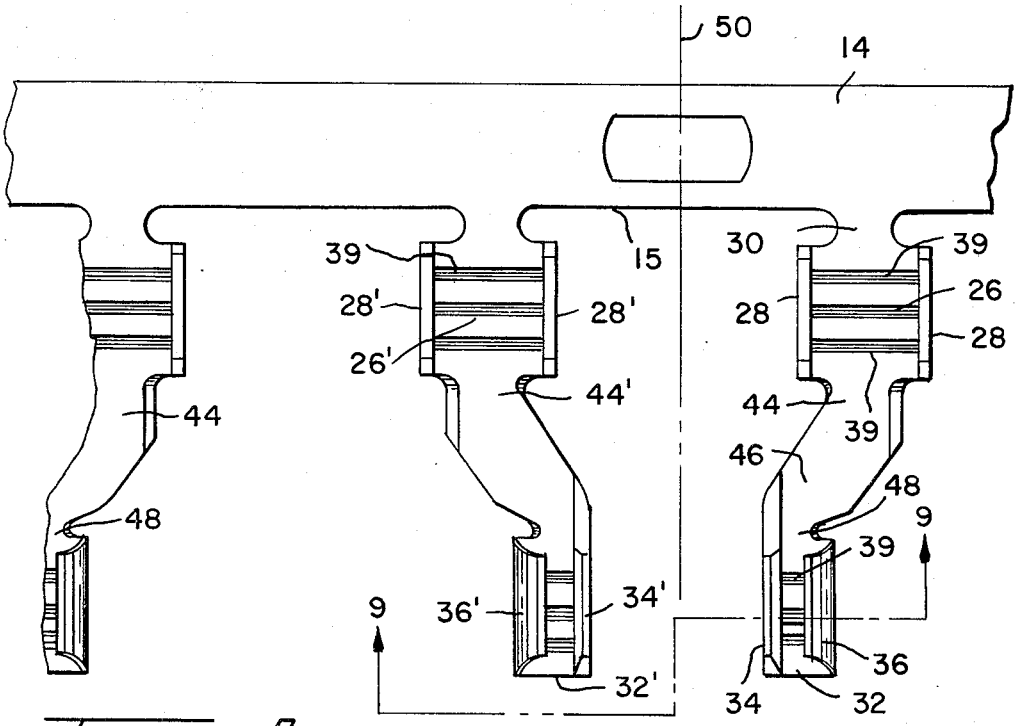
FIG. 8 is a top plan view of a portion of the formed strip.
Figure 9:
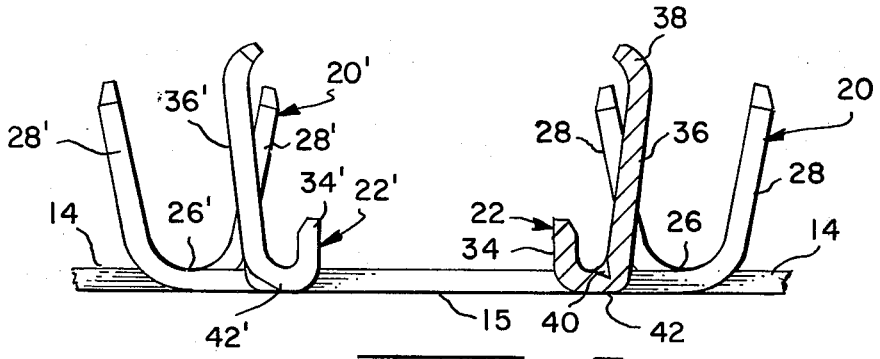

The transition section 24 is integral with one end of web 26 of the wire crimp portion, as shown at 44, and extends obliquely, as shown at 46, towards the axis 50. This transition section is then integral with the web 32 of the prong crimp portion as shown at 48. It will be apparent from the drawing that the prongs 2, 2' are relatively closely spaced, but it is not desirable to have the wire crimp portions as closely spaced as these prong crimp portions. Furthermore, because of the shape of the prongs which are generally rectangular but somewhat concave on their opposed surfaces, a specialized crimp is required to connect the splicing devices to the prongs. The plan view of the strip blank, FIG. 7, illustrates the fact that splicing devices, in accordance with the invention, can be produced with a minimum loss of material as scrap, by virtue of the J-shaped cross-section of the prong crimp portions and the transition sections 24 of the splicing devices. In FIG. 7, the same reference numerals, differentiated by the letter "a", are employed to identify the principal portions of the blank which correspond to the same portions of the formed splicing devices.

Figure 11:
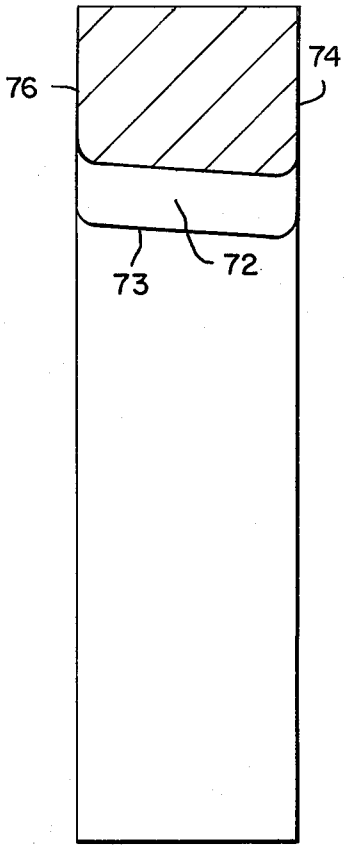
FIG. 11 is a view taken along the lines 11—11 of FIG. 10.
Figure 10:
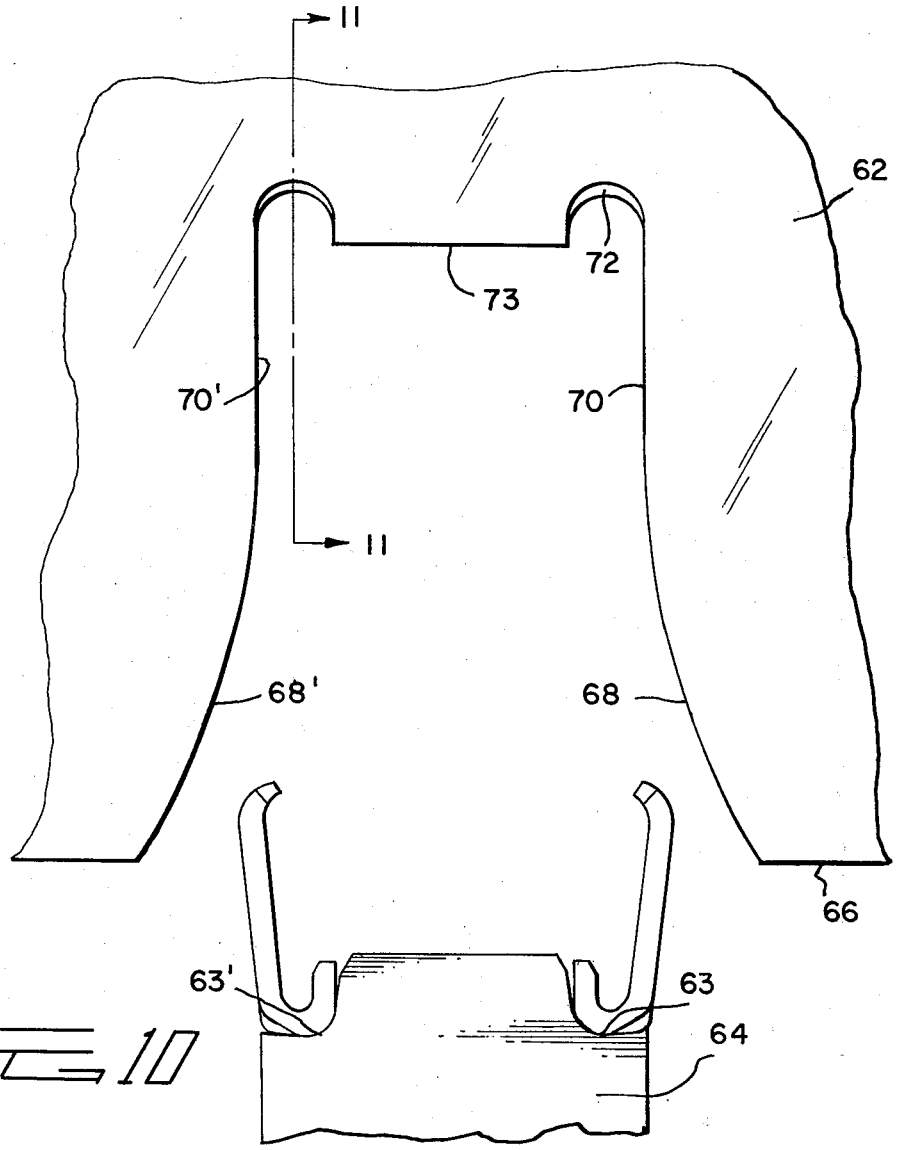
FIG. 10 is a fragmentary frontal view showing the crimping tooling, the die and anvil, for crimping the prong crimp portions of a set of splicing devices onto the prongs of a component.

Referring now to FIGS. 10 and 11, the prong crimp portions 22, 22', of a set of 16 of splicing devices, are crimped onto the prongs of a component by means of a crimping die 64, and a crimping anvil 62. The die 64 has recessed surfaces 63, 63' on its sides which support the flat external surfaces 42, 42' of the prong crimp portions. Surfaces 63 extend to vertical surfaces 65, 65' which support the low sidewalls 34, 34'. The recessed sides of the anvil 64 are separated by the upper end 67 of the anvil.

Figure 6:
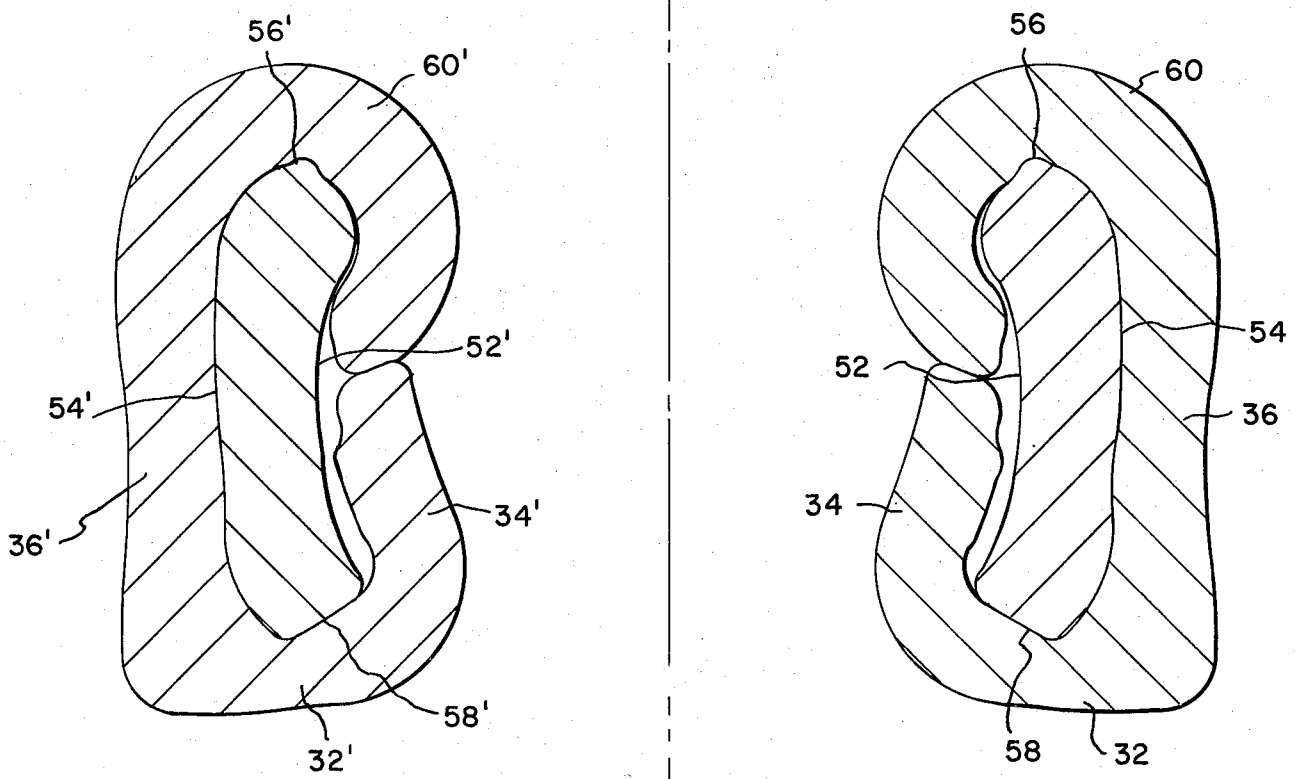
FIG. 6 is a cross-sectional view taken along the lines 6—6 of FIG. 1, showing details of the crimped connections between the prongs of the component and the connecting devices.

The crimping die 62 has a die opening extending upwardly from its lower end 66 which has arcuate lead-in surfaces 68, 68' which merge in turn with spaced-apart parallel surfaces 70, 70'. These surfaces in turn extend to substantially semi-cylindrical pockets 72, 72' on each side of the inner end 73 of the opening in the die plate. It will be apparent from FIG. 10 that upon placement of the prongs 2, 2' of a component 6 in the prong crimp portions 22, 22' of an uncrimped set of splicing devices and upon downward movement of the die 62, the high sidewalls 36, 36' will be flexed inwardly towards each other by the surfaces 68, 68' until they are substantially parallel to each other. Upon further downward movement of the die, the upper portions of the sidewalls 36, 36' will be curled by the surfaces 72, 72' and caused to bend downwardly until the prongs 2, 2' are enclosed by the sidewalls, as shown in FIG. 6. In the finished crimped connection, the low sidewall 34 and the deformed end portion 60 of the high sidewall extend partially over the concave inwardly directed major surface 52 of the prong. The outwardly directed major surface 54 is against the internal surface of the sidewall 36 and the edges 56, 58 are compressed between the curved portions of the crimped connection. Some metal will flow into the recess 40 in the web and the corrugations previously referred to, also ensure a tenacious grip of the crimped device on the prong.

It is desirable, as shown in FIG. 11, to provide a rake, or slope, on the surface 72 extending from the faces or sides 74, 76 of the crimping die and the inner end of the crimped connection, which is adjacent to the component, should be formed between portions of the surface 72 which are proximate to the side 76. The result will be that a taper will be provided on the crimped connection, which is of decreasing cross section as the end of the prong is approached.

Figure 5:
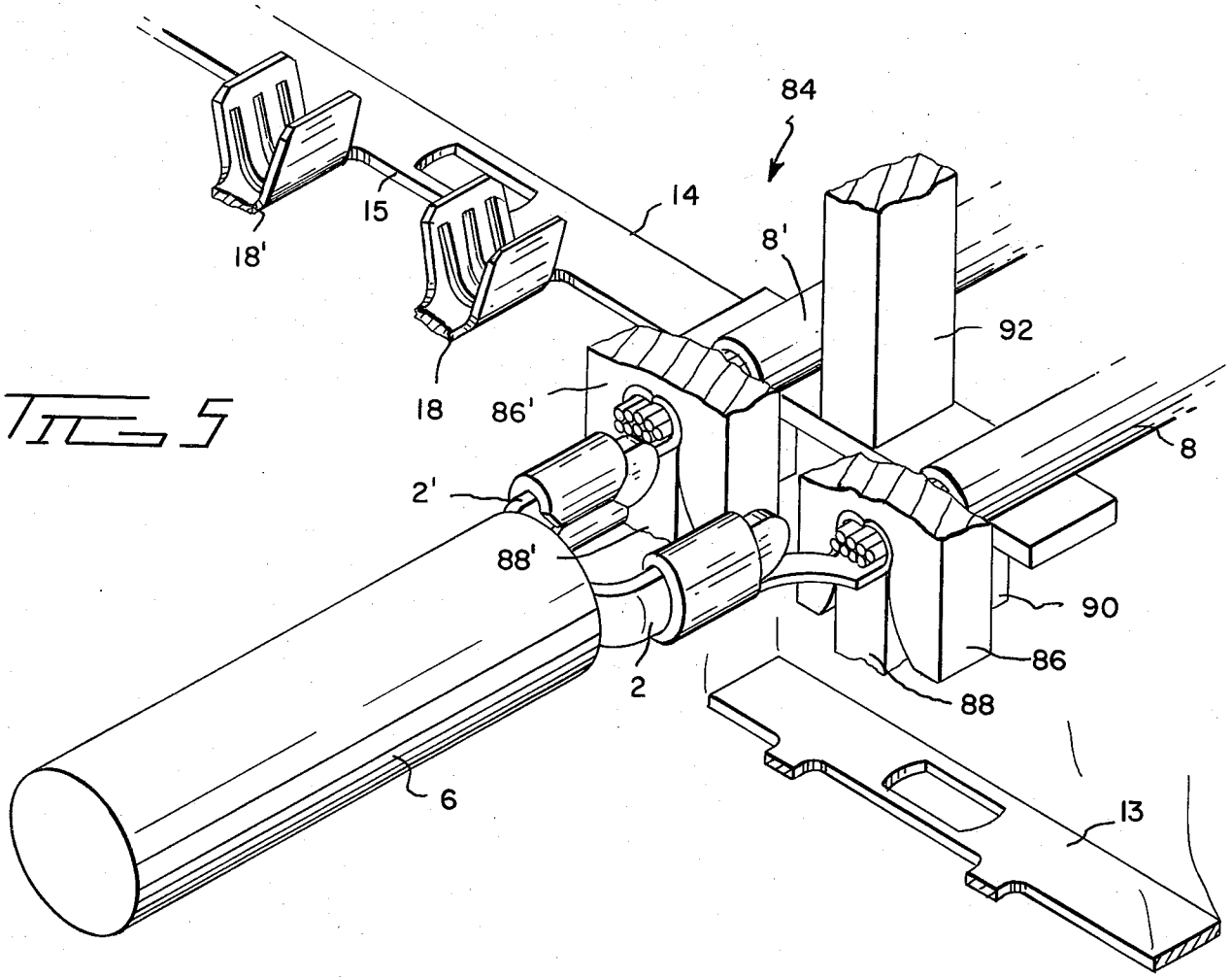
FIG. 5 is a perspective view illustrating the crimping of the wire crimp portions of the strip onto wires and severing of the connecting means from the carrier strip.

FIG. 5 illustrates the crimping apparatus for crimping the ends of wires 8, 8' and the wire crimp portions 20, 20' of the terminals. This crimping apparatus has crimping dies 86, 86' and crimping anvils 88, 88' which may be of conventional form. The apparatus further has a shearing means for severing the terminals from the carrier strip 14, this shearing means comprising a fixed shearing die 90 and a movable shearing die 92. The shearing means may also have provision for severing the carrier strip into discrete lengths to facilitate scrap removal as shown at 13 in FIG. 5.

Figure 12:
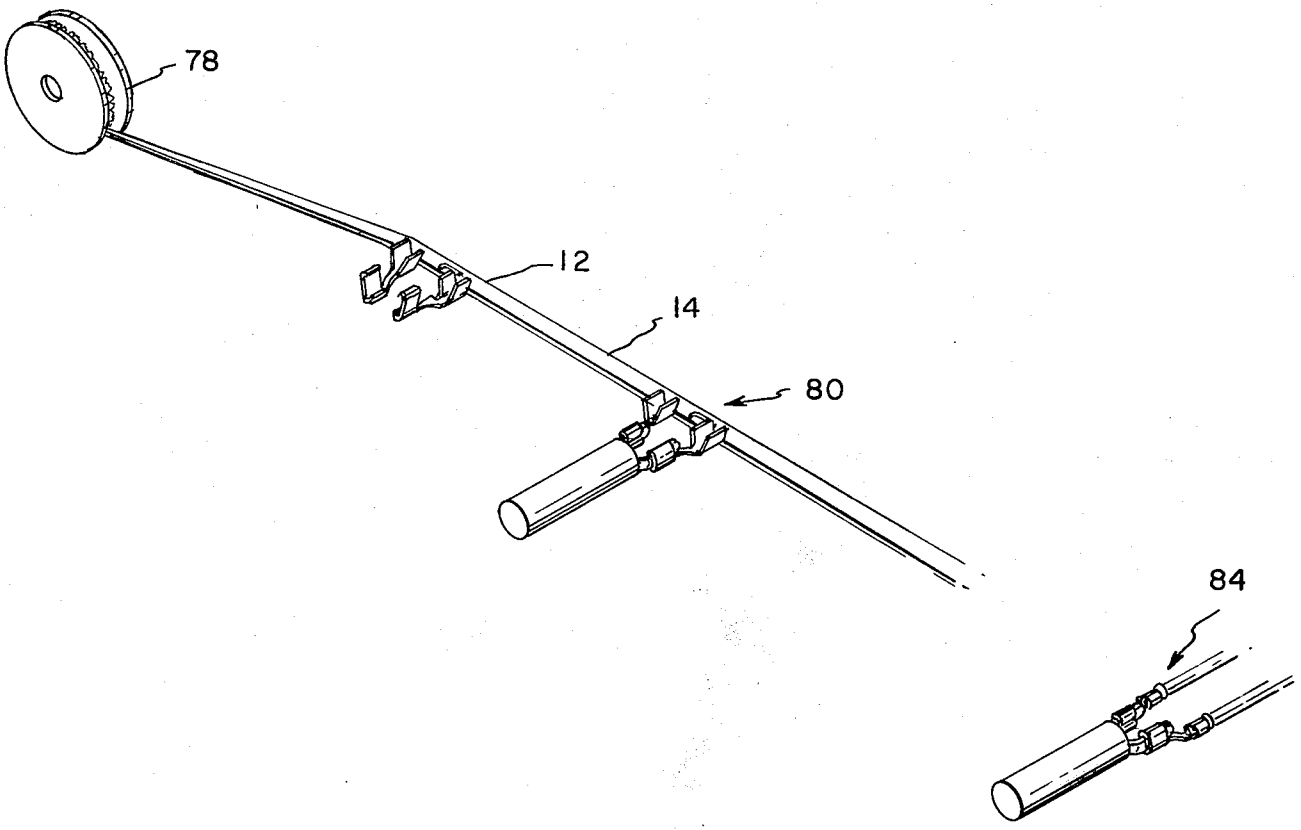
FIG. 12 is a perspective view illustrating the manufacturing process, in accordance with the invention, for connecting wires to prongs of a component.

FIG. 12 illustrates a manufacturing process for continuously producing terminated components, as shown in FIG. 1, in accordance with the invention. A reel 78 of connecting means, in accordance with the invention, is mounted adjacent to a first crimping station 80 and the strip 12 is fed to this station. During each crimping cycle, the prong crimp portions of one set 16 of splicing devices are crimped onto the prongs 2, 2' of a component. The resulting composite strip, as shown in FIG. 3, in which the components are connected to the splicing devices, can then be fed directly to a second crimping station 84 at which the ends of wires 8, 8' are connected to the wire crimp portions of the splicing devices and the individual sets of splicing devices are removed from the carrier strip 14, as shown in FIG. 5. The first crimping station 80 can be provided with means for feeding the loose-piece components to a crimping apparatus having the crimping die and anvil, shown in FIG. 10, therein and second crimping station 84 can also be completely automatic if desired, since it is common practice to feed terminal strip to a fully automatic crimping machine capable of crimping two terminals onto the ends of two wires.

A distinct advantage of the invention is achieved by virtue of the provision of the transition sections 46 of the splicing devices. These sections extend divergently from each other and are coplanar so that they are resistant to flexure towards each other, that is, flexure in their own planes. The wire crimp portions of the connecting devices are therefore rigidly held in spaced-apart relationship and the possibility of these two crimp portions touching each other is avoided.

Figure 4:
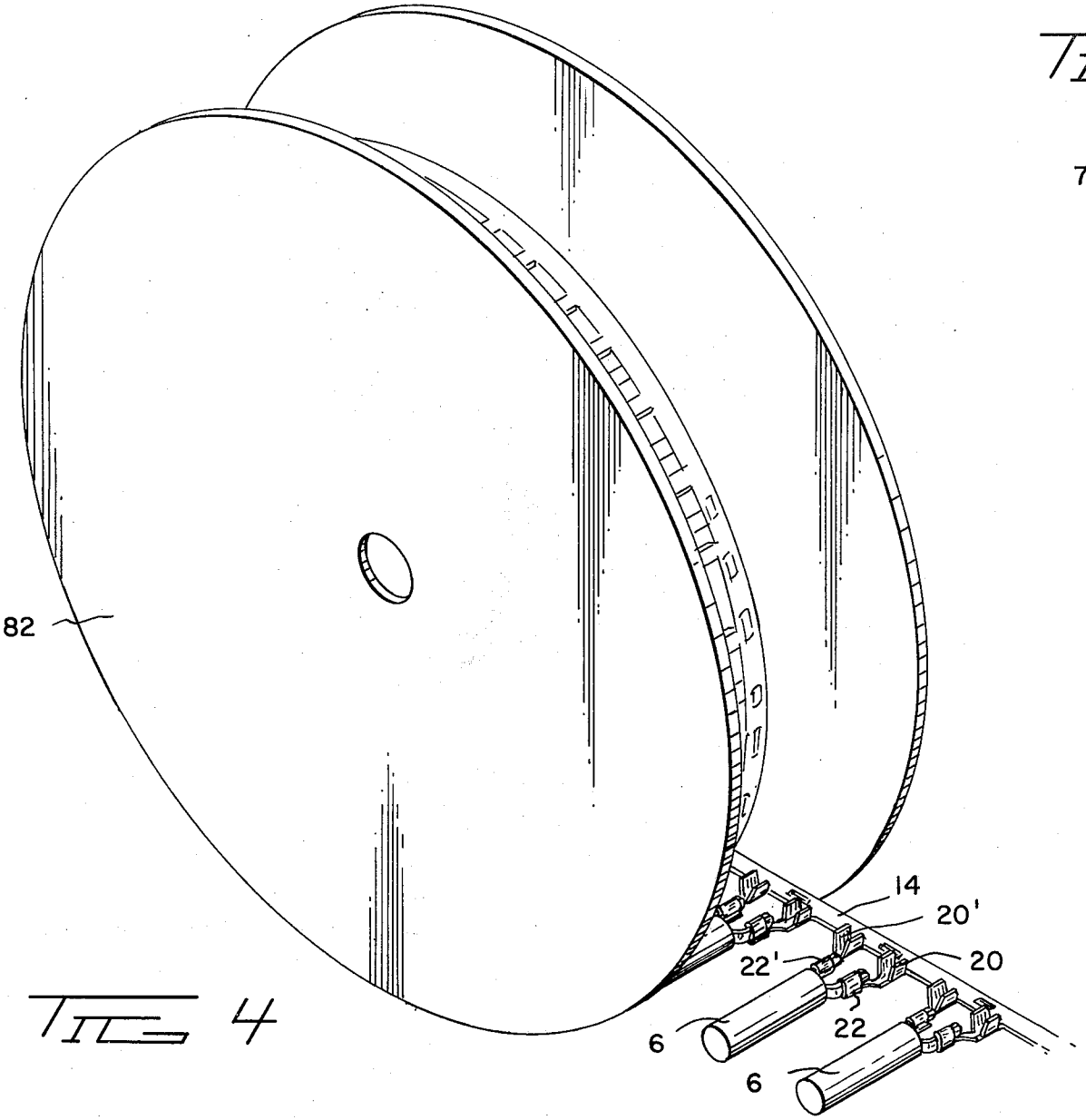
FIG. 4 is a perspective view of a reel of the composite strip.

Under some circumstances, it may be desirable to reel the composite strip which is produced by the crimping station 80, as shown at 82 in FIG. 4. The reels 82 can then be transported to the second crimping station which may be distant from the crimping station 80.

It will be apparent that varying degrees of automation might be employed in the manufacturing process depending upon such factors as the uniformity of the wire lengths 8, 8' and the number of pieces, or completed assemblies, which are to be produced. In all cases, substantial economies can be realized by the use of strip 12. Also, the manufacturer of the component 6 may crimp the strip onto the components and then supply the components in strip form to the user of the components.

While it is ordinarily preferable to produce the continuous strip 12 from a single strip of stock metal, as disclosed above, it is also possible to produce a strip similar to the strip 12 as a composite comprising two strips. To produce such a composite strip, a first strip would be stamped and die formed comprising a carrier strip having the terminals 20 integral therewith and a second strip would be produced comprising a carrier strip having the terminals 20' integral therewith. The two strips could then be secured together by placing the carrier strips against each other and welding or riveting the carrier strips to each other. This alternative may be desirable, for example, where it is desired to have the option of changing the spacing between the terminals 20, 20' by a slight amount for different prong spacing. In other words, when producing a composite strip for sensing devices having a first spacing between the prongs, the two carrier strips would be welded to each other with the terminals spaced apart by the required amount. If then at some subsequent time, it should be necessary to produce strip for a different sensing device having a different prong spacing, the carrier strips would simply be assembled to each other with the terminals spaced apart by the amount required for this different sensing device.

We claim:

1. Stamped and formed connecting means for making electrical connections of wires to electrical components of the type having first and second spaced-apart terminal prongs extending therefrom, said connecting means comprising:

a continuous carrier strip, a plurality of sets of crimpable splicing devices integral with said carrier strip, each of said sets comprising first and second splicing devices which extend from one side edge of said carrier strip in side-by-side spaced-apart relationship, said first splicing device of each set comprising a wire crimp portion, a prong crimp portion, and a connecting transition portion, said wire crimp portion having a wire crimp web and wire crimp sidewalls, said prong crimp portion having a prong crimp web and prong crimp sidewalls, said wire crimp portion being adjacent to said carrier strip and being integral at one end of said wire crimp web with said one side edge of said carrier strip, said prong crimp portion of said first splicing device being spaced from said wire crimp portion, said connecting transition portion extending from said wire crimp web to said prong crimp web, said first and second splicing devices of each set being substantially symmetrical with respect to an axis of symmetry which extends normally of said carrier strip and medially between said first and second splicing devices, whereby, said first and second prong crimp portions of a plurality of sets can be crimped in a first crimping machine onto said first and second prongs of a like plurality of said components thereby to produce a continuous strip of said components, and thereafter said strip of components can be fed to a second crimping machine at which said wire crimp portions of each set can be crimped onto wires and severed from said carrier strip.

2. Stamped and formed connecting means as set forth in claim 1, each of said prong crimp portions being generally J-shaped and having one relatively low sidewall and one relatively high sidewall, said low sidewalls of each set being proximate to said axis of symmetry, said high sidewalls being remote from said axis of symmetry.

3. Stamped and formed connecting means for making electrical connections of wires to electrical components of the type having first and second plate-like, spaced-apart, co-extensive terminal prongs extending therefrom, said connecting means comprising:

a continuous carrier strip, a plurality of sets of crimpable splicing devices integral with said carrier strip, each of said sets comprising first and second spilcing devices which extend from one side edge of said carrier strip in side-by-side spaced-apart relationship, said first splicing device of each set comprising a wire crimp portion, a prong crimp portion, and a connecting transition portion, said wire crimp portion being generally U-shaped and comprising a wire crimp web and sidewalls extending from said web, said wire crimp portion being adjacent to said carrier strip and being integral at one end of said wire crimp web with said one side edge of said carrier strip, said prong crimp portion of said first splicing device being spaced from said wire crimp portion and being generally J-shaped comprising a prong crimp web, a low sidewall, and a high sidewall, said connecting transition portion extending from said wire crimp web to said prong crimp web, said first and second splicing devices of each set having a mirror image relationship to each other with respect to an axis of symmetry which extends normally of said carrier strip and medially between said first and second splicing devices, said connecting transition sections extending obliquely towards said axis of symmetry whereby said J-shaped prong crimp portions are more closely spaced than said wire crimp portions, said low sidewalls of said J-shaped prong crimp portions being proximate to said axis of symmetry, said high sidewalls being remote from said axis of symmetry whereby, said first and second prong crimp portions of a plurality of said sets can be crimped in a first crimping machine onto said first and second prongs of a like plurality of said components thereby to produce a continuous strip of said components, and thereafter said strip of components can be fed to a second crimping machine at which said wire crimp portions of each set can be crimped onto wires and severed from said carrier strip.

4. A continuous composite strip comprising a plurality of sets of splicing devices and a like plurality of electrical components of the type having first and second substantially parallel spaced-apart terminal prongs extending therefrom, each of said components being associated with one of said sets of connecting devices, said composite strip comprising a continuous carrier strip, each of said sets of splicing devices comprising first and second splicing devices which extend from one side edge of said carrier strip in side-by-side spaced-apart relationship, said first splicing device of each set comprising a wire crimp portion, a prong crimp portion, and a connecting transition portion, said wire crimp portion having a wire crimp web and wire crimp sidewalls, said wire crimp portion being uncrimped, said prong crimp portion having a prong crimp web and prong crimp sidewalls, said wire crimp portion being adjacent to said carrier strip and being integral at one end of said wire crimp web with said one side edge of said carrier strip, said prong crimp portion of said first splicing device being spaced from said wire crimp portion, said connecting transition portion extending from said wire crimp web to said prong crimp web, said first and second splicing devices of each set being substantially symmetrical with respect to an axis of symmetry which extends normally of said carrier strip and medially between said first and second splicing devices, said connecting transition sections extending obliquely towards said axis of symmetry whereby said prong crimp portions are more closely spaced than said wire crimp portions, said first and second prong crimp portions of each of said sets being crimped onto said first and second prongs of said associated electrical component by first and second prong crimps, whereby, said components are held as part of said strip in side-by-side spaced-apart relationship to said carrier strip whereby, said strip can be fed to a crimping machine at which said wire crimp portions of each set can be crimped onto wires and severed from said carrier strip.

5. A continuous composite strip as set forth in claim 4, said prongs being plate-like members having opposed major surfaces and having outwardly directed major surfaces, one of said prong crimp sidewalls of each prong crimp extending entirely over said outwardly directed major surface of its respective prong, being bent around one edge of said prong and extending partially over said inwardly directed major surface, the other edge of said prong being against said prong crimp web, and the other one of said prong crimp sidewalls extending partially over said opposed major surface, said prong being compressed between said edges by said prong crimp.

6. A continuous composite crimp as set forth in claim 5, said prongs being arcuate in cross section, said opposed major surfaces being concave.

7. A continuous composite strip as set forth in claim 6, each of said components comprising a cylindrical housing, said prongs extending from one end of said housing.

8. An electrical component such as a sensor, having spaced-apart plate-like first and second terminal prongs extending therefrom, said prongs having opposed inwardly directed major surfaces and outwardly directed major surfaces, and first and second wires which are connected to said first and second prongs respectively, said first and second wires being connected to said first and second prongs by first and second stamped and formed splicing devices, said first splicing device comprising a prong crimp portion, a wire crimp portion and a connecting transition portion, said prong crimp portion of said first splicing device comprising a web which is against one edge of said first prong, a sidewall extending from said web across said outwardly directed major surface, said sidewall being bent around the other edge of said first prong and extending partially over said inwardly directed major surface, an additional sidewall extending from said web partially over said inwardly directed major surface, said sidewalls being crimped onto said first prong, said prong crimp portion of said second splicing device having a mirror image relationship to said prong crimp portion of said first splicing device, said connecting transition portion of said first and second splicing devices extending divergently from said web portion of said first and second prong crimp portion whereby said wire crimp portions are spaced apart by a distance which is greater than the spacing between said prong crimp portions.

9. The combination set forth in claim 8, said wire crimp portions of said splicing devices each comprising a web and sidewalls extending from side edge portions of said web, said sidewalls being crimped onto said wires, said transition portions of said splicing devices extending from webs of said wire crimp portions to said webs of said prong crimp portions, said transition portions being substantially flat and being coplanar whereby said wire crimp portions are rigidly held in spaced-apart relationship by said connecting transition portions.

10. The combination set forth in claim 9, said sidewalls of each of said prong crimp portions being crimped onto its respective prong by a tapered crimp which is of maximum tightness at the free end of the prong.

* * * * *